US008191888B2

(12) United States Patent
Matsumoto et al.

(10) Patent No.: US 8,191,888 B2
(45) Date of Patent: Jun. 5, 2012

(54) IMAGE FORMING APPARATUS AND COMPUTER READABLE MEDIUM

(75) Inventors: Shigeyuki Matsumoto, Kanagawa (JP); Takafumi Yamamoto, Kanagawa (JP); Mitsunori Shioi, Kanagawa (JP); Hiroki Orihara, Kanagawa (JP); Yohei Ito, Kanagawa (JP); Hiroshi Hayashi, Kanagawa (JP); Tatsuya Arakawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 12/874,259

(22) Filed: Sep. 2, 2010

(65) Prior Publication Data

US 2011/0218669 A1 Sep. 8, 2011

(30) Foreign Application Priority Data

Mar. 2, 2010 (JP) ..... 2010-045597

(51) Int. Cl.
*B65H 3/44* (2006.01)

(52) U.S. Cl. ..... 271/9.01; 271/258.01; 271/258.04

(58) Field of Classification Search ..... 271/9.01, 271/258.01, 258.04; 399/18, 21
See application file for complete search history.

(56) References Cited

U.S. PATENT DOCUMENTS

| | | | | |
|---|---|---|---|---|
| 5,534,976 | A | 7/1996 | Kim | |
| 2004/0022548 | A1 * | 2/2004 | Nagaoka | 399/16 |

FOREIGN PATENT DOCUMENTS

| | | | |
|---|---|---|---|
| JP | 11-84955 | A | 3/1993 |
| JP | 7-178987 | A | 7/1995 |
| JP | 2001-222139 | A | 8/2001 |
| JP | 2005-225672 | A | 8/2005 |
| JP | 2009-58937 | A | 3/2009 |

* cited by examiner

*Primary Examiner* — David H Bollinger
(74) *Attorney, Agent, or Firm* — Sughrue Mion, PLLC

(57) ABSTRACT

An image forming apparatus includes: a plurality of paper supplying trays; an image forming unit; and a cover. The image forming apparatus further includes a cover opening/closing detecting unit that detects an operation for opening/closing the cover; a paper supplying tray opening/closing detecting unit that detects an operation for opening/closing the paper supplying tray; a paper jam detecting unit that detects a paper jam in at least one place in a paper transporting path; a paper jam release deciding unit that decides whether the paper jam in the detecting place is released or not after the confirmation of a detection; and a completion control unit that controls to complete a paper jam processing based on the decision that the paper jam in all of the places in the paper transporting path is released through the paper jam release deciding unit.

8 Claims, 10 Drawing Sheets

FIG. 3

| JAM ZONE | JAM DETECTING CONDITION | MESSAGE EXAMPLE | JAM RELEASING CONDITION |
|---|---|---|---|
| COVER B | · ON-JAM DETECTION THROUGH REGISTRATION SENSOR IN DUPLEX PRINTING<br>· ON-JAM DETECTION THROUGH DUPLEX SENSOR<br>· OFF-JAM DETECTION THROUGH DUPLEX SENSOR | PAPER JAM :<br>PLEASE OPEN COVER B TO TAKE PAPER AWAY | · DUPLEX SENSOR PAPER NON-DETECTION |
| COVER A | · ON-JAM DETECTION THROUGH EXIT SENSOR<br>· OFF-JAM DETECTION THROUGH EXIT SENSOR<br>· OFF-JAM DETECTION THROUGH REGISTRATION SENSOR | PAPER JAM :<br>PLEASE OPEN COVER A TO TAKE PAPER AWAY | · REGISTRATION SENSOR PAPER NON-DETECTION |
| BETWEEN TRAYS 1 AND 2 | · ON-JAM DETECTION THROUGH REGISTRATION SENSOR<br>(TRAY 2 PASS SENSOR PAPER DETECTION) | PAPER JAM :<br>PLEASE OPEN TRAY 2 AND TRAY 1 TO TAKE PAPER AWAY | · TRAY 2 PASS SENSOR PAPER NON-DETECTION |
| BETWEEN TRAYS 2 AND 3 | · ON-JAM DETECTION THROUGH TRAY 2 PASS SENSOR<br>(TRAY 3 PASS SENSOR PAPER DETECTION) | PAPER JAM :<br>PLEASE OPEN TRAY 3 AND TRAY 2 TO TAKE PAPER AWAY | · TRAY 3 PASS SENSOR PAPER NON-DETECTION |
| BETWEEN TRAYS 3 AND 4 | · ON-JAM DETECTION THROUGH TRAY 3 PASS SENSOR<br>(TRAY 4 PASS SENSOR PAPER DETECTION) | PAPER JAM :<br>PLEASE OPEN TRAY 4 AND TRAY 3 TO TAKE PAPER AWAY | · TRAY 4 PASS SENSOR PAPER NON-DETECTION |

OPEN COVER A
TO REMOVE JAM

OPEN COVER B
TO REMOVE JAM

OPEN TRAY
TO REMOVE JAM

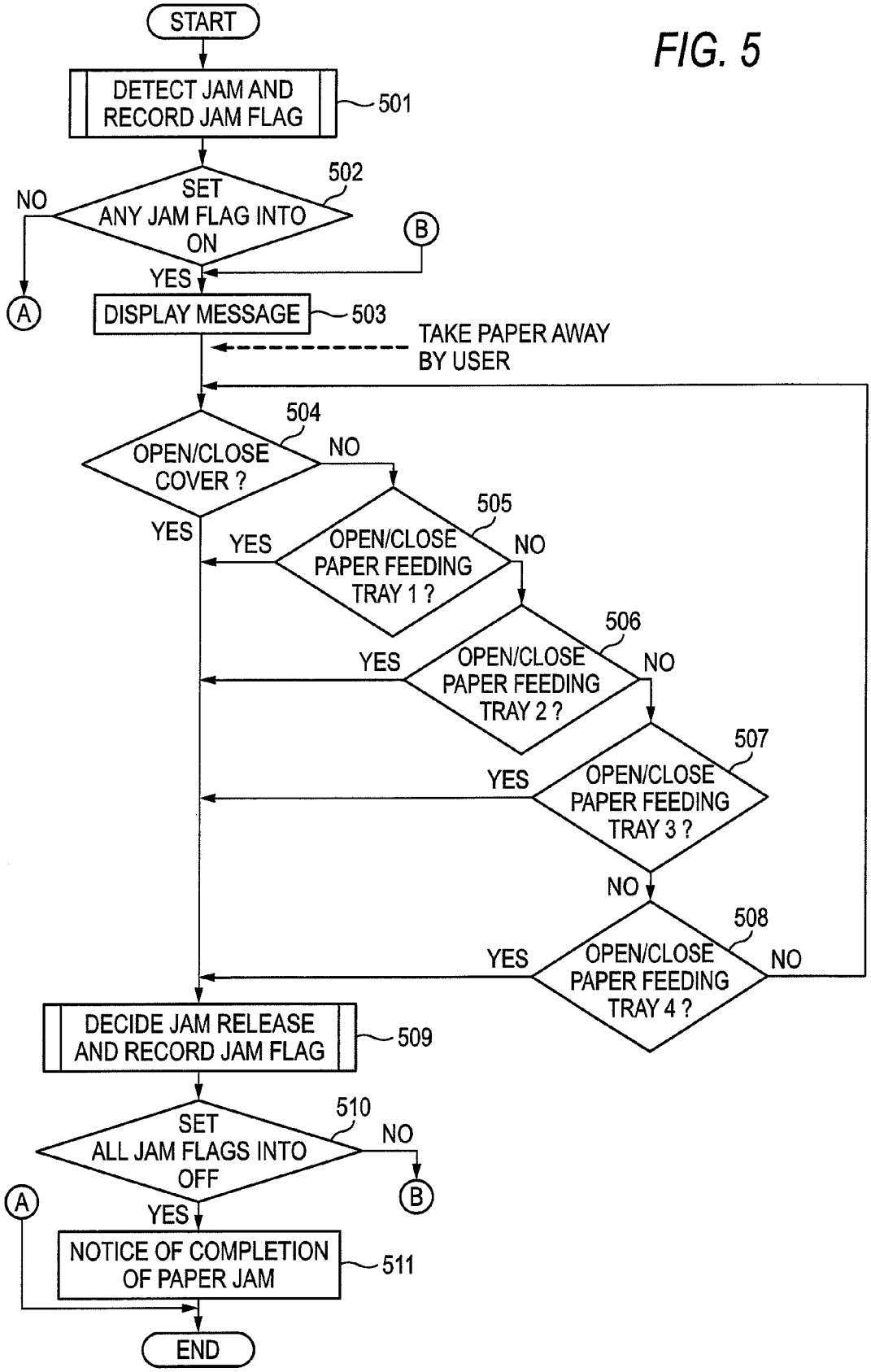
FIG. 5
START
DETECT JAM AND RECORD JAM FLAG
501
SET ANY JAM FLAG INTO ON
502
NO
YES
B
A
DISPLAY MESSAGE
503
TAKE PAPER AWAY BY USER
OPEN/CLOSE COVER ?
504
NO
YES
OPEN/CLOSE PAPER FEEDING TRAY 1 ?
505
YES
NO
OPEN/CLOSE PAPER FEEDING TRAY 2 ?
506
YES
NO
OPEN/CLOSE PAPER FEEDING TRAY 3 ?
507
YES
NO
OPEN/CLOSE PAPER FEEDING TRAY 4 ?
508
YES
NO
DECIDE JAM RELEASE AND RECORD JAM FLAG
509
SET ALL JAM FLAGS INTO OFF
510
NO
B
A
YES
NOTICE OF COMPLETION OF PAPER JAM
511
END

PAPER JAM : PLEASE OPEN COVER A
TO TAKE PAPER AWAY

TWO LINES

PAPER JAM : PLEASE OPEN TRAY 3 AND TRAY 2
TO TAKE PAPER AWAY

TWO LINES

IMAGE FORMING APPARATUS AND COMPUTER READABLE MEDIUM

CROSS-REFERENCE TO RELATED APPLICATION

This application is based on and claims priority under 35 USC 119 from Japanese Patent Application No. 2010-045597 filed on Mar. 2, 2010.

BACKGROUND

1. Technical Field

The present invention relates to an image forming apparatus and a computer readable medium.

2. Related Art

In an image forming apparatus, there is caused a phenomenon referred to as a "jam" in which a paper gets jammed during a transport due to a paper defect or a malfunction of the apparatus in some cases.

When the jam occurs, a user opens a housing cover to take away the paper getting jammed over a paper transporting path in the vicinity of a print engine.

When the housing cover is closed, then, a notice of a completion of a paper jam processing is displayed on a user interface so that the user confirms that the jam is released.

SUMMARY

According to an aspect of the invention, an image forming apparatus includes:

a plurality of paper supplying trays that stores a paper to form an image;

an image forming unit that forms the image on the paper supplied from the paper supplying tray;

a cover to be opened by an operator in order to take away the paper getting jammed in the image forming unit;

a cover opening/closing detecting unit that detects an operation for opening/closing the cover by the operator;

a paper supplying tray opening/closing detecting unit that detects an operation for opening/closing the paper supplying tray;

a paper jam detecting unit that detects a paper jam in at least one place in a paper transporting path through which the paper is transported;

a confirming unit that confirms a first detection of the operation for opening/closing the cover through the cover opening/closing detecting unit after the paper jam is detected by the paper jam detecting unit or a second detection of the operation for opening/closing the paper supplying tray through the paper supplying tray opening/closing detecting unit;

a paper jam release deciding unit that decides whether the paper jam in the detecting place is released or not after the confirmation of the first or second detection through the confirming unit; and a completion control unit that controls to complete a paper jam processing based on the decision that the paper jam in all of the places in the paper transporting path is released through the paper jam release deciding unit.

BRIEF DESCRIPTION OF THE DRAWINGS

Exemplary embodiments of the invention will be described in detail based on the following figures, wherein:

FIG. 3 is a table showing a jam detecting condition and a jam releasing condition, FIG. 5 is a flowchart showing a processing in the image forming apparatus 100.

DETAILED DESCRIPTION

Examples according to the invention will be described below in detail with reference to the accompanying drawings.

First Example

First of all, an image forming apparatus 100 according to an image forming apparatus and a computer readable medium in accordance with the invention will be described with reference to FIG. 1.

Figure 1:
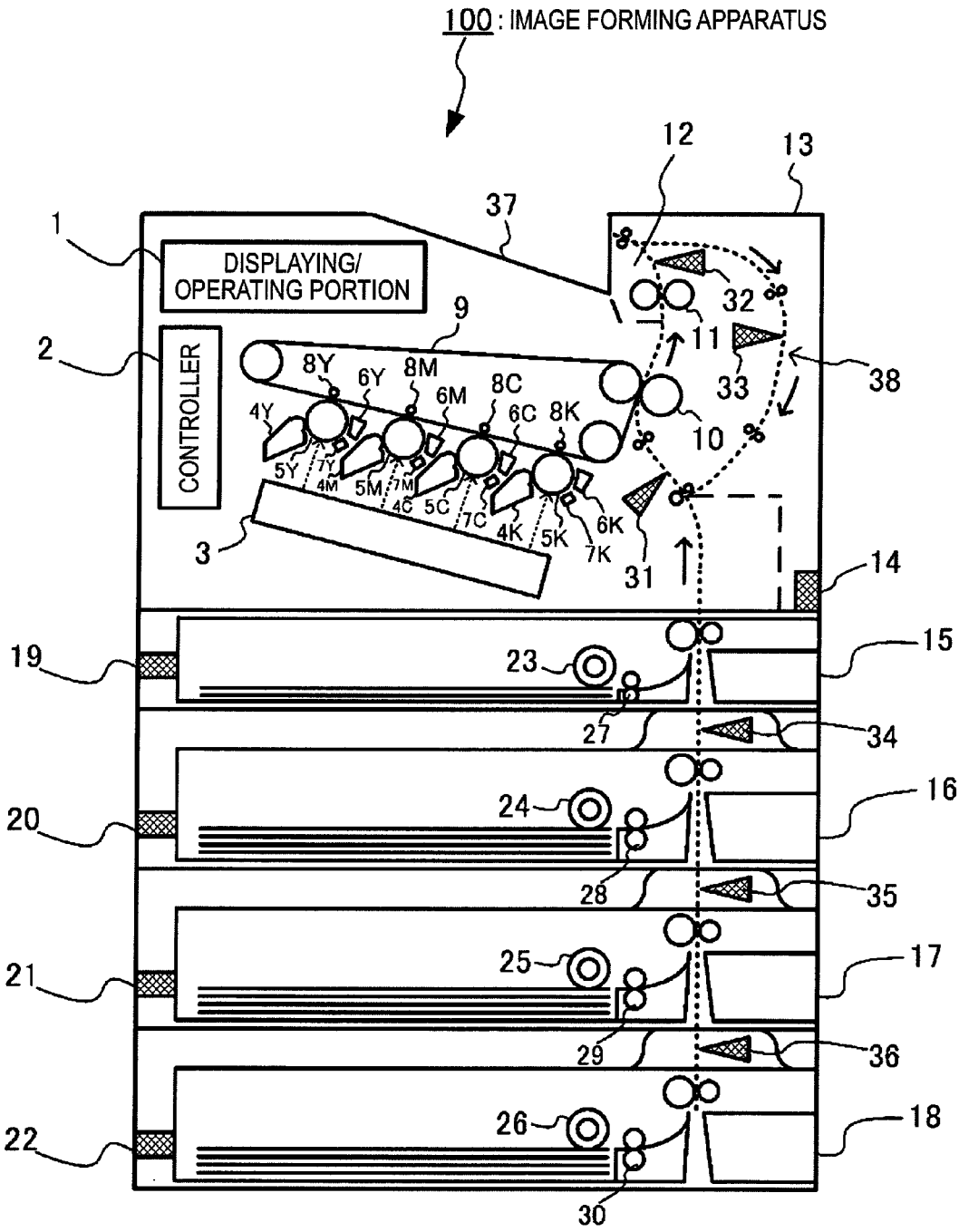
FIG. 1 is a typical view showing a structure of an image forming apparatus 100.

FIG. 1 is a typical view showing the image forming apparatus 100 according to the image forming apparatus and the computer readable medium in accordance with the invention.

As shown in FIG. 1, the image forming apparatus 100 includes a displaying/operating portion 1, a controller 2, an exposing device 3, a developing unit 4 (having a developing unit 4Y for yellow, a developing unit 4M for magenta, a developing unit 4C for cyan and a developing unit 4K for black), a photosensitive member 5 (having a photosensitive member 5Y for yellow, a photosensitive member 5M for magenta, a photosensitive member 5C for cyan and a photosensitive member 5K for black), a cleaning device 6 (having a cleaning device 6Y for yellow, a cleaning device 6M for magenta, a cleaning device 6C for cyan and a cleaning device 6K for black), a charging device 7 (having a charging device 7Y for yellow, a charging device 7M for magenta, a charging device 7C for cyan and a charging device 7K for black), a primary transfer roll 8 (having a primary transfer roll 8Y for yellow, a primary transfer roll 8M for magenta, a primary transfer roll 8C for cyan and a primary transfer roll 8K for black), an intermediate transfer belt 9, a secondary transfer roll 10, a fixing device 11, a cover A (12), a cover B (13), a cover opening/closing detecting sensor 14, a paper supplying tray 1 (15), a paper supplying tray 2 (16), a paper supplying tray 3 (17), a paper supplying tray 4 (18), a paper supplying tray 1 opening/closing detecting sensor (19), a paper supplying tray 2 opening/closing detecting sensor (20), a paper supplying tray 3 opening/closing detecting sensor (21), a paper supplying tray 4 opening/closing detecting sensor (22), a pickup roll 23 for a paper supplying tray 1, a pickup roll 24 for a paper supplying tray 2, a pickup roll 25 for a paper supplying tray 3, a pickup roll 26 for a paper supplying tray 4, a retard roll 27 for the paper supplying tray 1, a retard roll 28 for the paper supplying tray 2, a retard roll 29 for the paper supplying tray 3, a retard roll 30 for the paper supplying tray 4, a registration sensor 31, an exit sensor 32, a duplex sensor 33, a tray 2 pass sensor (34), a tray 3 pass sensor (35), a tray 4 pass sensor (36), and a paper discharging tray 37.

Moreover, the image forming apparatus 100 includes an inversion transporting path 38 to be a transporting path for inverting a paper which inverts the paper having a toner fixed by the fixing device 11, thereby enabling duplex printing.

In the image forming apparatus 100, there is a possibility that a paper might not be normally transported due to a paper defect or a malfunction, that is, a jam (a paper jam) might be caused during a print processing.

The displaying/operating portion 1 has a function of a user interface for displaying information to a user and accepting an instruction from the user. When the jam occurs in the image forming apparatus 100, a message corresponding to a region in which the jam occurs is displayed on the displaying/operating portion 1.

The controller 2 includes a CPU 40 for controlling an operation of the image forming apparatus 100 and an image processing portion 48 for generating image data, and serves to chiefly control respective components such as the exposing device 3 and the developing unit 4, thereby printing image data onto a paper. Furthermore, the controller 2 manages a jam detection and a jam releasing decision.

The exposing device 3 is controlled by the controller 2 to form an electrostatic latent image based on image data on the photosensitive member 5Y for yellow, the photosensitive member 5M for magenta, the photosensitive member 5C for cyan and the photosensitive member 5K for black.

The developing unit 4Y develops the electrostatic latent image formed on the photosensitive member 5Y with a toner to form a toner image on the photosensitive member 5Y. The developing unit 4M develops the electrostatic latent image formed on the photosensitive member 5M with a toner, thereby forming a toner image on the photosensitive member 5M. The developing unit 4C develops the electrostatic latent image formed on the photosensitive member 5C with a toner, thereby forming a toner image on the photosensitive member 5C. The developing unit 4K develops the electrostatic latent image formed on the photosensitive member 5K with a toner, thereby forming a toner image on the photosensitive member 5K.

The toner image formed on the photosensitive member 5 for each color is transferred from the photosensitive member 5 for each color onto the intermediate transfer belt 9 by means of the primary transfer roll 8 for each color, and is thus transported toward the secondary transfer roll 10 together with a movement of the intermediate transfer belt 9.

A paper to be printed is accommodated in one of the paper supplying tray 1 (15), the paper supplying tray 2 (16), the paper supplying tray 3 (17) and the paper supplying tray 4 (18). The paper supplying tray 1 (15), the paper supplying tray 2 (16), the paper supplying tray 3 (17) and the paper supplying tray 4 (18) accommodate the papers and may be opened/closed by a user.

The image forming apparatus 100 has a structure of a multistage tray including plural of paper supplying trays. As shown in FIG. 1, the paper supplying tray 1 (15), the paper supplying tray 2 (16), the paper supplying tray 3 (17) and the paper supplying tray 4 (18) are disposed sequentially in close order to a print engine.

In the case in which the paper accommodated in the paper supplying tray 1 (15) is used for printing, it is sent out by the pickup roll 23 for the paper supplying tray 1. The paper thus sent out is prevented from being multi-supplied by means of the retard roll 27.

The paper passing through the retard roll 27 is transported over a transporting path and passes through a detecting region of the registration sensor 31, and is transported to the secondary transfer roll 10.

The registration sensor 31 is disposed in a position on this side of the secondary transfer roll 10 in the paper transporting path and serves to detect a presence of the paper which is transported. The registration sensor 31 is constituted by a sensor including a light emitting device and a light receiving device, for example, and the light receiving device detects that a light of the light emitting device is shielded by the transported paper, thereby detecting the presence of the paper.

In the case in which the paper accommodated in the paper supplying tray 2 (16) is used for the printing, moreover, it is sent out by the pickup roll 24 for the paper supplying tray 2. The paper thus sent out is prevented from being multi-supplied by means of the retard roll 28.

The paper passing through the retard roll 28 is transported along a transporting path turned toward the paper supplying tray 1 (15) positioned in an upper stage of the paper supplying tray 2 (16). The tray 2 pass sensor (34) is disposed on this side of the paper supplying tray 1 (15) over the transporting path turned toward the paper supplying tray 1 (15). The paper accommodated in the paper supplying tray 2 (16) and passing through the retard roll 28 passes through a detecting region of the tray 2 pass sensor (34) and is transported to the paper supplying tray 1 (15), and thereafter passes through the detecting region of the registration sensor 31 via the transporting path along which the paper accommodated in the paper supplying tray 1 (15) is sent when it is to be used for the printing, and is thus transported to the secondary transfer roll 10.

Each of the tray 2 pass sensor (34), the tray 3 pass sensor (35) and the tray 4 pass sensor (36) serves to detect the presence of the paper to be transported thereto, and is constituted by a sensor including a light emitting device and a light receiving device, for example, and the light receiving device detects that a light of the light emitting device is shielded by the transported paper, thereby detecting the presence of the paper.

In the case in which the paper accommodated in the paper supplying tray 3 (17) is used for the printing, moreover, it is sent out by the pickup roll 25 for the paper supplying tray 3. The paper thus sent out is prevented from being multi-supplied by means of the retard roll 29.

The paper passing through the retard roll 29 is transported along a transporting path turned toward the paper supplying tray 2 (16) positioned in an upper stage of the paper supplying tray 3 (17). The tray 3 pass sensor (35) is disposed on this side of the paper supplying tray 2 (16) over the transporting path turned toward the paper supplying tray 2 (16). The paper accommodated in the paper supplying tray 3 (17) and passing through the retard roll 29 passes through a detecting region of the tray 3 pass sensor (35) and is transported to the paper supplying tray 2 (16), and thereafter passes through the detecting region of the tray 2 pass sensor (34) via the transporting path along which the paper accommodated in the paper supplying tray 2 (16) is sent when it is to be used for the printing, and is thus transported to the paper supplying tray 1 (15), and subsequently, passes through the detecting region of the registration sensor 31 via the transporting path along which the paper accommodated in the paper supplying tray 1 (15) is sent when it is to be used for the printing and is thus transported to the secondary transfer roll 10.

In the case in which the paper accommodated in the paper supplying tray 4 (18) is used for the printing, moreover, it is sent out by the pickup roll 26 for the paper supplying tray 4.

The paper thus sent out is prevented from being multi-supplied by means of the retard roll 30.

The paper passing through the retard roll 30 is transported along a transporting path turned toward the paper supplying tray 3 (17) positioned in an upper stage of the paper supplying tray 4 (18). The tray 4 pass sensor (36) is disposed on this side of the paper supplying tray 3 (17) over the transporting path turned toward the paper supplying tray 3 (17). The paper accommodated in the paper supplying tray 4 (18) and passing through the retard roll 30 passes through a detecting region of the tray 4 pass sensor (36) and is transported to the paper supplying tray 3 (17), and thereafter passes through the detecting region of the tray 3 pass sensor (35) via the transporting path along which the paper accommodated in the paper supplying tray 3 (17) is sent when it is to be used for the printing, and is thus transported to the paper supplying tray 2 (16), and subsequently, passes through the detecting region of the tray 2 pass sensor (34) via the transporting path along which the paper accommodated in the paper supplying tray 2 (16) is sent when it is to be used for the printing and is thus transported to the paper supplying tray 1 (15), and next, passes through the detecting region of the registration sensor 31 via the transporting path along which the paper accommodated in the paper supplying tray 1 (15) is sent when it is to be used for the printing and is thus transported to the secondary transfer roll 10.

Thus, the paper accommodated in the paper supplying tray 1 (15) is transported and passes through the detecting region of the registration sensor 31, and is transported to the secondary transfer roll 10.

Moreover, the paper accommodated in the paper supplying tray 2 (16) is transported and passes through the detecting region of the tray 2 pass sensor (34) and the detecting region of the registration sensor 31, and is transported to the secondary transfer roll 10.

Furthermore, the paper accommodated in the paper supplying tray 3 (17) is transported and passes through the detecting region of the tray 3 pass sensor (35), the detecting region of the tray 2 pass sensor (34) and the detecting region of the registration sensor 31, and is transported to the secondary transfer roll 10.

In addition, the paper accommodated in the paper supplying tray 4 (18) is transported and passes through the detecting region of the tray 4 pass sensor (36), the detecting region of the tray 3 pass sensor (35), the detecting region of the tray 2 pass sensor (34) and the detecting region of the registration sensor 31, and is transported to the secondary transfer roll 10.

Consequently, the toner image on the intermediate transfer belt 9 is transferred, by the secondary transfer roll 10, onto the paper transported to the secondary transfer roll 10.

The paper having the toner image transferred thereonto is transported to the fixing device 11, and is subjected to a fixing treatment by heat and pressure through the fixing device 11.

The paper subjected to the fixing treatment is transported from the fixing device 11 and then passes through a detecting region of the exit sensor 32, and is then discharged to the paper discharging tray 37.

The exit sensor 32 is disposed in a position of the paper transporting path which passes through the fixing device 11, and serves to detect the presence of the paper which is transported via the fixing device 11. The exit sensor 32 is constituted by a sensor including a light emitting device and a light receiving device, for example, and the light receiving device detects that a light of the light emitting device is shielded by the transported paper, thereby detecting the presence of the paper.

The cover A (12) forms a part of a housing for covering the print engine and can be opened/closed. The cover A (12) is opened so that the vicinity of the registration sensor 31 and the secondary transfer roll 10 is confirmed by the user. In some cases, the user opens the cover A (12) in accordance with a message displayed on the displaying/operating portion 1 when carrying out a jam release. Thus, the user can take away the paper getting jammed in the vicinity of the registration sensor 31 and the secondary transfer roll 10.

Moreover, the user can also take away the paper protruded toward a downstream side of the transporting path by means of the paper supplying tray 1 (15) by opening the cover A (12). For example, a single paper (to be taken away for the jam release) contained in the detecting region of the tray 2 pass sensor (34) and having an end protruded from the paper supplying tray 1 (15) to the downstream side of the transporting path is not taken away by opening the paper supplying tray 2 (16) on an upstream side of the transporting path but is preferably taken away by opening the cover A (12) to pull the end of the paper protruded from the paper supplying tray 1 (15) to the downstream side of the transporting path at the downstream side of the transporting path. The reason is that the paper to be taken away is moved in a transporting direction. Therefore, it is possible to produce an advantage that the tray 2 pass sensor (34) is broken with difficulty.

The cover B (13) forms a part of a housing for covering the inversion transporting path 38 and can be opened/closed. The cover B (13) is opened so that the inversion transporting path 38 is confirmed by the user. In some cases, the user opens the cover B (13) in accordance with a message displayed on the displaying/operating portion 1 when carrying out the jam release.

In some cases, the cover B (13) is opened by the user when releasing the jam detected by the duplex sensor 33.

The duplex sensor 33 is disposed on the inversion transporting path 38 and serves to detect the presence of the paper which is transported. The duplex sensor 33 is constituted by a sensor including a light emitting device and a light receiving device, for example, and the light receiving device detects that a light of the light emitting device is shielded by the transported paper, thereby detecting the presence of the paper.

The cover opening/closing detecting sensor 14 serves to detect an operation for opening/closing the cover A (12) or the cover B (13).

The paper supplying tray 1 opening/closing detecting sensor (19) serves to detect an operation for opening/closing the paper supplying tray 1 (15).

The paper supplying tray 2 opening/closing detecting sensor (20) serves to detect an operation for opening/closing the paper supplying tray 2 (16).

The paper supplying tray 3 opening/closing detecting sensor (21) serves to detect an operation for opening/closing the paper supplying tray 3 (17).

The paper supplying tray 4 opening/closing detecting sensor (22) serves to detect an operation for opening/closing the paper supplying tray 4 (18).

The pickup roll 23 serves to send out the paper accommodated in the paper supplying tray 1 (15).

The retard roll 27 serves to separate the papers sent out by the pickup roll 23 one by one and to supply them to the transporting path in cooperation with a supply roll disposed opposite thereto.

The pickup roll 24 serves to send out the paper accommodated in the paper supplying tray 2 (16).

The retard roll 28 serves to separate the papers sent out by the pickup roll 24 one by one and to supply them to the transporting path in cooperation with a supply roll disposed opposite thereto.

The pickup roll 25 serves to send out the paper accommodated in the paper supplying tray 3 (17).

The retard roll 29 serves to separate the papers sent out by the pickup roll 25 one by one and to supply them to the transporting path in cooperation with a supply roll disposed opposite thereto.

The pickup roll 26 serves to send out the paper accommodated in the paper supplying tray 4 (18).

The retard roll 30 serves to separate the papers sent out by the pickup roll 26 one by one and to supply them to the transporting path in cooperation with a supply roll disposed opposite thereto.

Next, a structure of the controller 2 will be described with reference to FIG. 2.

Figure 2:
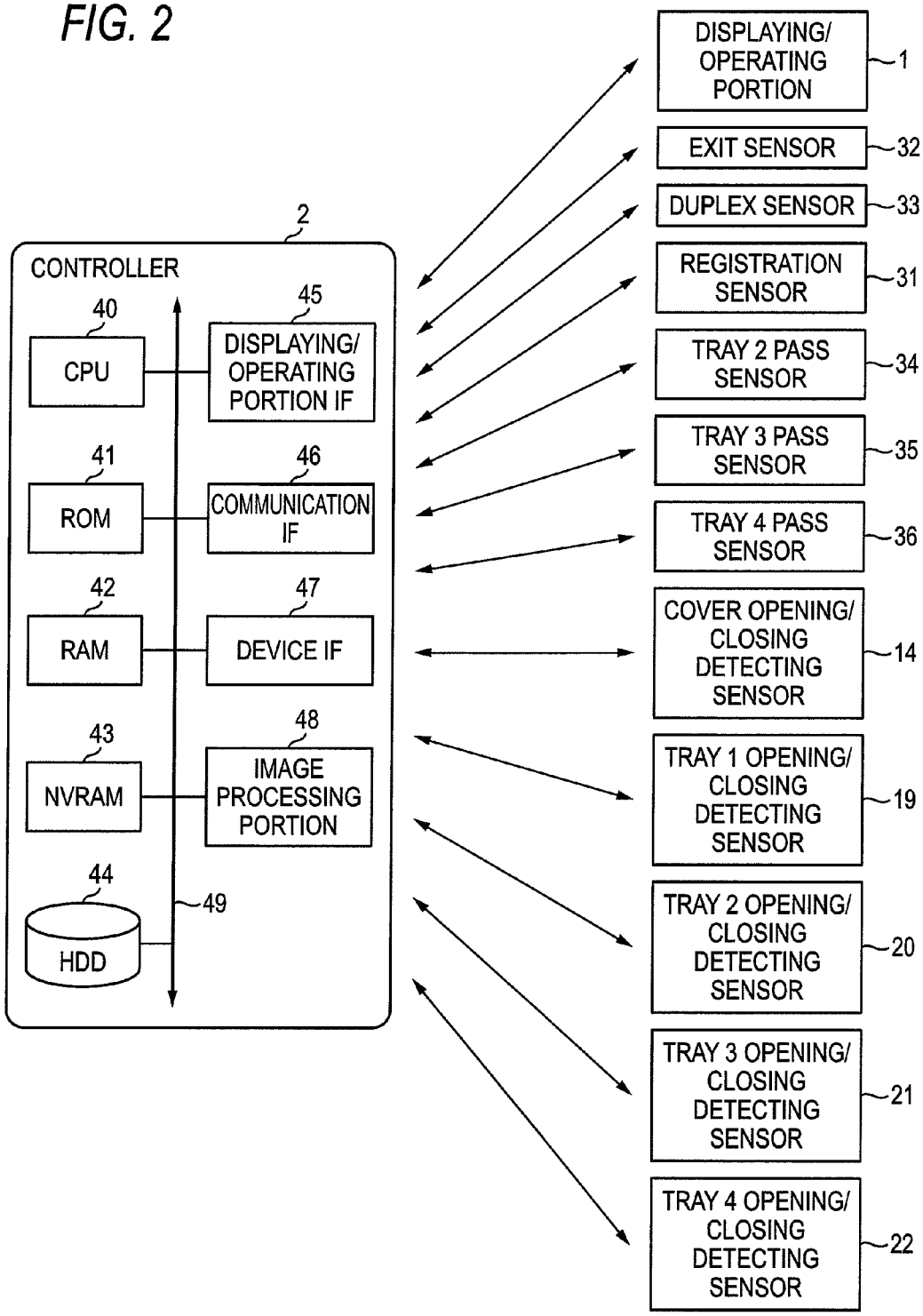
FIG. 2 is a typical diagram showing a structure of a controller 2.

FIG. 2 is a typical diagram showing the structure of the controller 2, illustrating a part of components of the image forming apparatus 100 to be controlled by the controller 2.

As shown in FIG. 2, the controller 2 has the CPU (Central Processing Unit) 40, an ROM (Read Only Memory) 41, an RAM (Random Access Memory) 42, an NVRAM (Non Volatile Random Access Memory) 43, an HDD (Hard Disk Drive) 44, a displaying/operating portion user interface (which will be hereinafter referred to as an displaying/operating portion IF as is illustrated in the drawing) 45, a communication interface (which will be hereinafter referred to as a communication IF as is illustrated in the drawing) 46, a device interface (which will be hereinafter referred to as a device IF as is illustrated in the drawing) 47, and the image processing portion 48, and they are connected to enable a communication with each other through a bus 49.

The CPU 40 serves to chiefly control the image forming apparatus 100.

The ROM 41 stores a firmware of the image forming apparatus 100 and a serial number, a manufacturing number and a manufacturing date of the image forming apparatus 100.

The RAM 42 temporarily stores a system variable in order to operate the firmware stored in the ROM 41.

The NVRAM 43 is a rewritable nonvolatile memory and serves to temporarily store a system variable in order to operate the firmware stored in the ROM 41.

The HDD 44 serves to store image data.

The displaying/operating portion IF 45 serves as an interface with the displaying/operating portion 1.

The communication IF 46 serves as an interface with a communication line which is not shown, and serves to receive print data from a personal computer which is not shown.

The device IF 47 serves as an interface with the print engine such as the exposing device 3, the developing unit 4 or the photosensitive member 5.

The image processing portion 48 serves to generate image data based on the print data received by the communication IF 46.

The controller 2 having the structure carries out a communication with the displaying/operating portion 1, the exit sensor 32, the duplex sensor 33, the registration sensor 31, the tray 2 pass sensor 34, the tray 3 pass sensor 35, the tray 4 pass sensor 36, the cover opening/closing detecting sensor 14, the tray 1 opening/closing detecting sensor 19, the tray 2 opening/closing detecting sensor 20, the tray 3 opening/closing detecting sensor 21 and the tray 4 opening/closing detecting sensor 22, and receives a signal from each of the sensors.

The CPU 40 of the controller 2 serves to decide whether a state of each of the exit sensor 32, the duplex sensor 33, the registration sensor 31, the tray 2 pass sensor 34, the tray 3 pass sensor 35 and the tray 4 pass sensor 36 is set to be a paper detecting state (a paper detection) or a paper non-detecting state (a paper non-detection) based on the signal received from each of the sensors.

Moreover, the CPU 40 of the controller 2 serves to decide whether the cover A (12) or the cover B (13) is opened or closed based on a signal received from the cover opening/closing detecting sensor 14.

Based on a signal received from each of the tray 1 opening/closing detecting sensor 19, the tray 2 opening/closing detecting sensor 20, the tray 3 opening/closing detecting sensor 21 and the tray 4 opening/closing detecting sensor 22, furthermore, the CPU 40 of the controller 2 serves to decide whether each of the trays is opened or closed.

Next, a management for a jam occurring in the image forming apparatus 100 will be described with reference to FIG. 3.

FIG. 3 is a table showing a division of the jam occurring in the image forming apparatus 100 for various regions, and a message given to a user and a jam releasing condition for the jam caused in each of the regions.

When a printing operation is to be carried out by the image forming apparatus 100, the occurrence of the jam is detected through a detection of a time required for sending out the paper from the pickup roll (any of the pickup rolls 23, 24, 25 and 26 corresponding to the paper supplying tray from which the paper is sent out) of the paper supplying tray (any of the paper supplying tray 1 (15), the paper supplying tray 2 (16), the paper supplying tray 3 (17) and the paper supplying tray 4 (18)) and then passing through each of the paper detecting sensors (any of the exit sensor 32, the duplex sensor 33, the registration sensor 31, the tray 2 pass sensor 34, the tray 3 pass sensor 35 and the tray 4 pass sensor 36).

For example, in the case in which the paper does not reach the registration sensor 31 within a set time after it is sent out by the pickup roll 23, the occurrence of the jam in relation to the registration sensor 31 is detected by the CPU 40. At this time, the paper does not reach the paper detecting sensor (in this case, the registration sensor 31) within the set time. Therefore, the CPU 40 decides that an ON-jam is detected by the paper detecting sensor (in this case, the registration sensor 31).

Moreover, in the case in which the paper is sent out by the pick-up roll 23 and then reaches the registration sensor 31, and is continuously detected by the registration sensor 31, for example, it can be supposed that the paper does not get out of the registration sensor 31. Consequently, the CPU 40 decides that an OFF jam is detected by the registration sensor 31.

Thus, the jam has two types, that is, the ON-jam in which the paper does not reach the paper detecting sensor and the OFF jam in which the paper does not get out of the paper detecting sensor, and they are decided by the CPU 40.

As shown in FIG. 3, moreover, a jam zone to be a division of the region in which the jam occurs is set into five types, that is, "Cover B", "Cover A", "Between trays 1 and 2", "Between trays 2 and 3" and "Between trays 3 and 4".

FIG. 3 shows a condition that the jam is detected in each of the jam zones, a message example corresponding to each of the jam zones for the jam which occurs, and a releasing condition corresponding to each of the jam zones for the jam which occurs.

As shown in FIG. 3, the condition of the jam detection in the jam zone "Cover B" indicates the case in which the ON-jam is detected by the registration sensor 31, the case in which the ON jam is detected by the duplex sensor 33 or the case in which the OFF jam is detected by the duplex sensor 33 in duplex printing. In the case in which the jam is detected, it is assumed that the jam occurs in the jam zone "Cover B".

Moreover, the condition of the jam detection in the jam zone "Cover A" indicates the case in which the ON-jam is detected by the exit sensor 32, the case in which the OFF jam is detected by the exit sensor 32 or the case in which the OFF jam is detected by the registration sensor 31 as shown in FIG. 3. In the case in which the jam is detected, it is assumed that the jam occurs in the jam zone "Cover A".

Furthermore, the condition of the jam detection in the jam zone "Between trays 1 and 2" indicates the case in which the ON jam is detected by the registration sensor 31 as shown in FIG. 3. In the case in which the ON jam is detected by the registration sensor 31, thus, it is assumed that the jam occurs in the jam zone "Between trays 1 and 2". In some cases in which the ON-jam is detected by the registration sensor 31, moreover, the tray 2 pass sensor 34 is set into the paper detection.

In addition, the condition of the jam detection in the jam zone "Between trays 2 and 3" indicates the case in which the ON jam is detected by the tray 2 pass sensor 34 as shown in FIG. 3. In the case in which the ON jam is detected by the tray 2 pass sensor 34, thus, it is assumed that the jam occurs in the jam zone "Between trays 2 and 3". In some cases in which the ON-jam is detected by the tray 2 pass sensor 34, moreover, the tray 3 pass sensor 35 is set into the paper detection.

Furthermore, the condition of the jam detection in the jam zone "Between trays 3 and 4" indicates the case in which the ON jam is detected by the tray 3 pass sensor 35 as shown in FIG. 3. In the case in which the ON-jam is detected by the tray 3 pass sensor 35, thus, it is assumed that the jam occurs in the jam zone "Between trays 3 and 4". In some cases in which the ON-jam is detected by the tray 3 pass sensor 35, moreover, the tray 4 pass sensor 36 is set into the paper detection.

Although the description has been given to the condition of the jam detection in each of the jam zones, the invention is not restricted to the condition but the jam detection may be set on the other conditions. For example, the ON jam may be assumed to be detected by the registration sensor 31 on the condition of the jam detection in the "Cover A".

In the case in which a jam in a certain jam zone is detected by the CPU 40, the CPU 40 records a jam flag corresponding to the jam zone to be "on" in the RAM 42.

When detecting the jam, then, the CPU 40 displays, on the displaying/operating portion 1, a message corresponding to the jam zone in which the jam is detected.

In the case in which the jam in the jam zone "Cover B" is detected, a message of "Paper jam: Please open the cover B to take a paper away" is displayed on the displaying/operating portion 1 as shown in FIG. 3.

In the case in which the jam in the jam zone "Cover A" is detected, a message of "Paper jam: Please open the cover A to take a paper away" is displayed on the displaying/operating portion 1 as shown in FIG. 3.

In the case in which the jam in the jam zone "Between trays 1 and 2" is detected, a message of "Paper jam: Please open the trays 2 and 1 to take a paper away" is displayed on the displaying/operating portion 1 as shown in FIG. 3.

In the case in which the jam in the jam zone "Between trays 2 and 3" is detected, a message of "Paper jam: Please open the trays 3 and 2 to take a paper away" is displayed on the displaying/operating portion 1 as shown in FIG. 3.

In the case in which the jam in the jam zone "Between trays 3 and 4" is detected, a message of "Paper jam: Please open the trays 4 and 3 to take a paper away" is displayed on the displaying/operating portion 1 as shown in FIG. 3.

The message to be displayed on the displaying/operating portion 1 is not restricted to the words described above.

A condition for deciding whether the jam is released or not (a jam releasing condition) which will be described below indicates that the duplex sensor 33 is set into a paper non-detecting state as shown in FIG. 3 in case of the jam occurring in the jam zone "Cover B". The jam releasing condition is used for deciding the jam release by the CPU 40 after the cover A (12), the cover B (13), the paper supplying tray 1 (15), the paper supplying tray 2 (16), the paper supplying tray 3 (17) or the paper supplying tray 4 (18) is confirmed to be opened/closed, which will be described below in detail.

The jam releasing condition of the jam occurring in the jam zone "Cover A" indicates that the registration sensor 31 is set into the paper non-detecting state as shown in FIG. 3.

The jam releasing condition of the jam occurring in the jam zone "Between trays 1 and 2" indicates that the tray 2 pass sensor (34) is set into the paper non-detecting state as shown in FIG. 3.

The jam releasing condition of the jam occurring in the jam zone "Between trays 2 and 3" indicates that the tray 3 pass sensor (35) is set into the paper non-detecting state as shown in FIG. 3.

The jam releasing condition of the jam occurring in the jam zone "Between trays 3 and 4" indicates that the tray 4 pass sensor (36) is set into the paper non-detecting state as shown in FIG. 3.

Figure 4A:
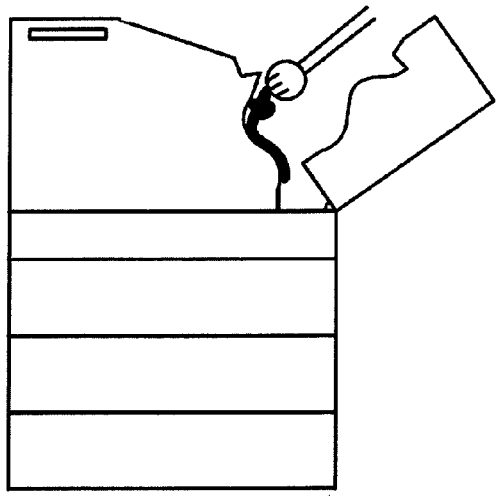
FIGS. 4A to 4C are typical views showing situation in which a paper getting jammed is taken away.
Figure 4B:
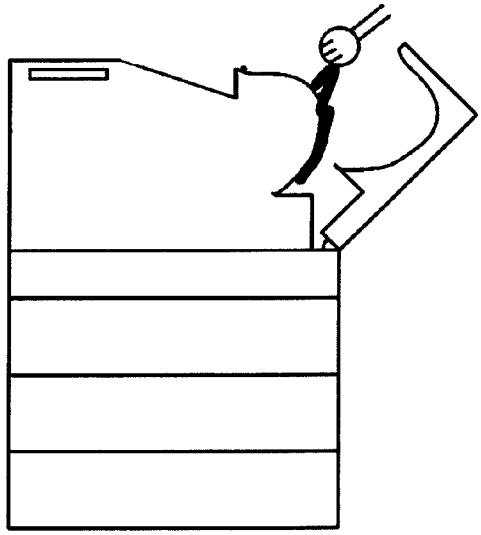
Figure 4C:
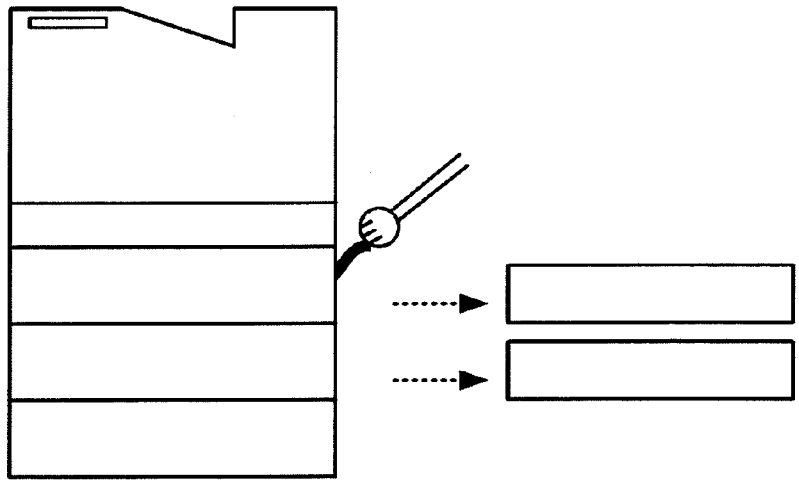

With reference to FIGS. 4A to 4C, next, description will be given to a situation in which a paper getting jammed is taken away by a user when a jam occurs in the image forming apparatus 100.

FIGS. 4A to 4C are typical views showing a situation in which a user takes away a paper getting jammed when a jam occurs in the image forming apparatus 100. FIG. 4A is a typical view showing a situation in which the cover A (12) is opened to take away the paper getting jammed, FIG. 4B is a typical view showing a situation in which the cover B (13) is opened to take away the paper getting jammed, and FIG. 4C is a typical view showing a situation in which the paper supplying tray is opened to take away the paper getting jammed.

When the jam occurs in the image forming apparatus 100 and the message of "Paper jam: Please open the cover A to take a paper away" is displayed on the displaying/operating portion 1, the user opens the cover A (12) as shown in FIG. 4A. By opening the cover A (12), then, the user can take away a paper getting jammed in the secondary transfer roll 10 or the registration sensor 31 in the print engine.

By opening the cover A (12), moreover, the user can take away a paper getting jammed in a paper transporting path other than the inversion transporting path 38 in the print engine.

By opening the cover A (12), furthermore, the user can also take away a paper sent out of any of the paper supplying trays and protruded toward the print engine side from the paper supplying tray 1 (15) which is the closest to the print engine.

When the jam occurs in the image forming apparatus 100 and the message of "Paper jam: Please open the cover B to take a paper away" is displayed on the displaying/operating portion 1, moreover, the user opens the cover B (13) as shown in FIG. 4B. By opening the cover B (13), then, the user can take away a paper getting jammed in the inversion transporting path 38 for duplex printing in the print engine.

When a jam occurs in the jam zone "Between trays 1 and 2", the jam zone "Between trays 2 and 3" or the jam zone "Between trays 3 and 4" in the image forming apparatus 100, furthermore, the user opens a specified one of the paper supplying trays to take away the paper getting jammed in accordance with the message displayed on the displaying/operating portion 1 as shown in FIG. 4C.

A work for opening the paper supplying tray is the same as that for pulling the paper supplying tray out.

With reference to FIG. 5, next, description will be given to a processing for detecting a jam and deciding a jam release in the image forming apparatus 100.

FIG. 5 is a flowchart showing the processing for detecting a jam occurring in the image forming apparatus 100 and deciding a jam release.

As shown in FIG. 5, first of all, a processing for detecting a jam and recording, in the RAM 42, a jam flag for the jam thus detected is executed by the CPU 40 in the image forming apparatus 100 (Step 501). Then, the CPU 40 decides whether a jam flag in any of the jam zones is recorded to be "on" in the RAM 42 or not. If the jam flag is not recorded to be "on" (NO in.

Step 502), the processing is ended (through a connector A in the flowchart).

If the image forming apparatus 100 is carrying out a printing operation, the processing of the Step 501 is started in such a manner that the jam is subsequently detected during the printing operation after the jam flag is not recorded to be "on" but the processing is ended at the Step 502.

Figure 6:
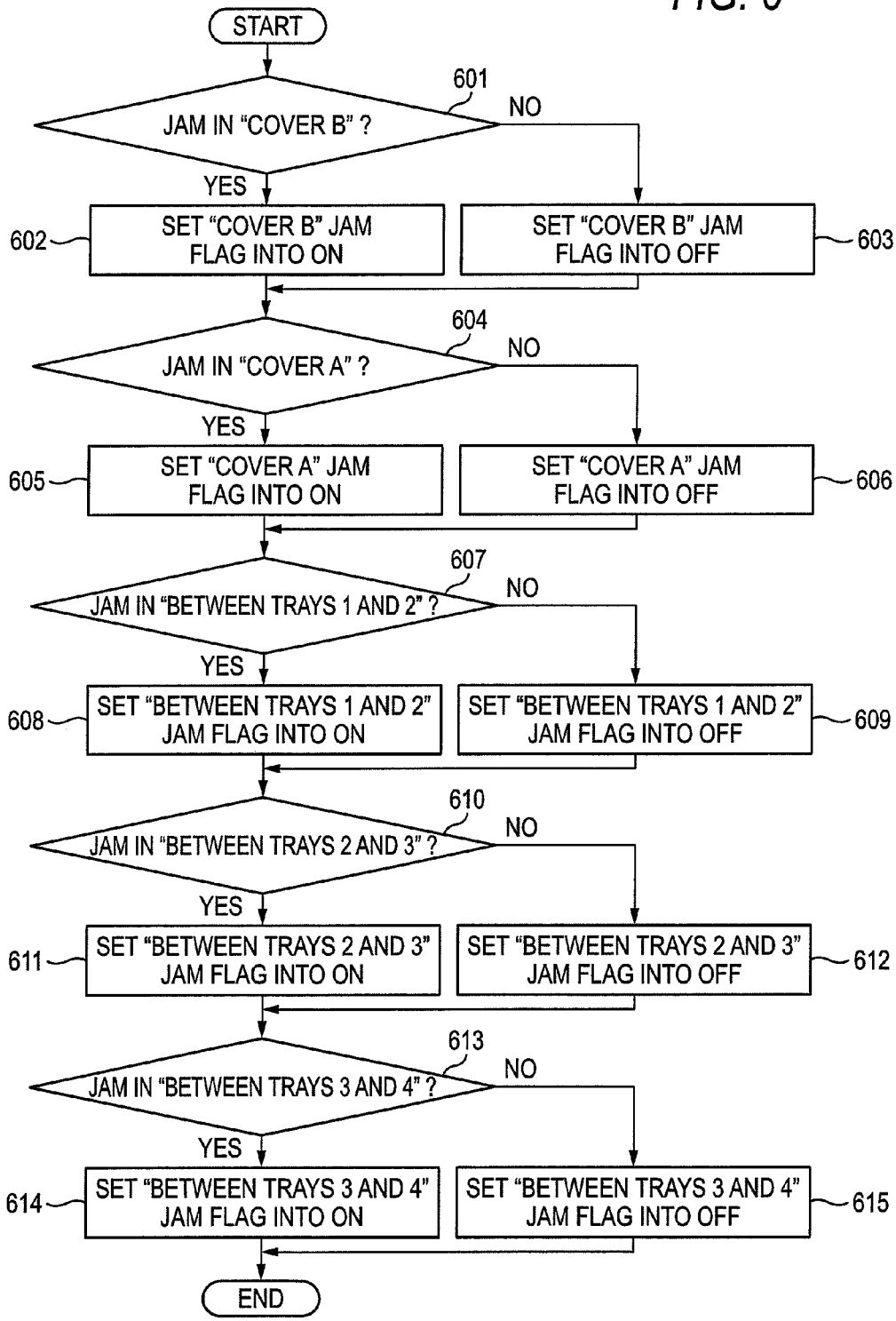
FIG. 6 is a flowchart showing a jam detecting and jam flag recording processing.

With reference to FIG. 6, description will be given to the processing for detecting a jam and recording a jam flag which is to be executed at the Step 501.

First of all, the CPU 40 decides whether a jam occurs in the jam zone "Cover B" or not based on the condition of the jam detection in the jam zone "Cover B" as shown in FIG. 6 (Step 601). The condition of the jam detection in the jam zone "Cover B" has contents described with reference to FIG. 3.

If it is detected that the jam occurs in the "Cover B" (YES in the Step 601), the CPU 40 records the jam flag in the jam zone "Cover B" to be "on" in the RAM 42 (Step 602).

If the jam is not detected in the "Cover B" at the Step 601 (NO in the Step 601), the CPU 40 deletes the jam flag in the jam zone "Cover B" in the RAM 42 (sets the jam flag into "off") (Step 603).

Then, the CPU 40 decides whether a jam occurs in the jam zone "Cover A" or not based on the condition of the jam detection in the jam zone "Cover A" (Step 604). The condition of the jam detection in the jam zone "Cover A" has contents described with reference to FIG. 3.

If it is detected that the jam occurs in the "Cover A" (YES in the Step 604), the CPU 40 records the jam flag in the jam zone "Cover A" to be "on" in the RAM 42 (Step 605).

If the jam is not detected in the "Cover A" at the Step 604 (NO in the Step 604), the CPU 40 deletes the jam flag in the jam zone "Cover A" in the RAM 42 (sets the jam flag into "off") (Step 606).

Then, the CPU 40 decides whether the jam occurs in the jam zone "Between trays 1 and 2" or not based on the condition of the jam detection in the jam zone "Between trays 1 and 2" (Step 607). The condition of the jam detection in the jam zone "Between trays 1 and 2" has contents described with reference to FIG. 3.

If it is detected that the jam occurs in the "Between trays 1 and 2" (YES in the Step 607), the CPU 40 records the jam flag in the jam zone "Between trays 1 and 2" to be "on" in the RAM 42 (Step 608).

If the jam is not detected in the "Between trays 1 and 2" at the Step 607 (NO in the Step 607), the CPU 40 deletes the jam flag in the jam zone "Between trays 1 and 2" in the RAM 42 (sets the jam flag into "off") (Step 609).

Thereafter, the CPU 40 decides whether the jam occurs in the jam zone "Between trays 2 and 3" or not based on the condition of the jam detection in the jam zone "Between trays 2 and 3" (Step 610). The condition of the jam detection in the jam zone "Between trays 2 and 3" has contents described with reference to FIG. 3.

If it is detected that the jam occurs in the "Between trays 2 and 3" (YES in the Step 610), the CPU 40 records the jam flag in the jam zone "Between trays 2 and 3" to be "on" in the RAM 42 (Step 611).

If the jam is not detected in the "Between trays 2 and 3" at the Step 610 (NO in the Step 610), the CPU 40 deletes the jam flag in the jam zone "Between trays 2 and 3" in the RAM 42 (sets the jam flag into "off") (Step 612).

Subsequently, the CPU 40 decides whether the jam occurs in the jam zone "Between trays 3 and 4" or not based on the condition of the jam detection in the jam zone "Between trays 3 and 4" (Step 613). The condition of the jam detection in the jam zone "Between trays 3 and 4" has contents described with reference to FIG. 3.

If it is detected that the jam occurs in the "Between trays 3 and 4" (YES in the Step 613), the CPU 40 records the jam flag in the jam zone "Between trays 3 and 4" to be "on" in the RAM 42 (Step 614).

If the jam is not detected in the "Between trays 3 and 4" at the Step 613 (NO in the Step 613), the CPU 40 deletes the jam flag in the jam zone "Between trays 3 and 4" in the RAM 42 (sets the jam flag into "off") (Step 615).

Thus, there is executed the processing for detecting the jam and recording the jam flag at the Step 501.

With reference to FIG. 5, description will be subsequently given to the processing to be executed in the image forming apparatus 100. When the processing for detecting the jam and recording the jam flag is executed at the Step 501 so that the jam flag in any of the jam zones is recorded to be "on" in the RAM 42 (YES in the Step 502), the CPU 40 displays, on the displaying/operating portion 1, a message corresponding to the jam zone in which the jam flag is "on" (Step 503).

The message to be displayed on the displaying/operating portion 1 may correspond to all of the jam zones in which the jam flags are recorded to be "on" or may correspond to a part of the jam zones in which the jam flags are recorded to be "on".

In the case in which a column of the displaying/operating portion 1 for displaying the message to the user is small and the messages for all of the jams cannot be displayed, there is displayed a message corresponding to a part of the jam zones in which the jam flags are recorded to be "on". In the case in which the message corresponding to only a part of the jam zones is displayed, it is also possible to previously give priority to the jam zone and to preferentially display a message corresponding to any of the jam zones which has high priority and in which the jam flag is recorded to be "on" as will be described below in detail.

Consequently, the user opens the cover or the paper supplying tray which is specified by the message displayed on the displaying/operating portion 1 in accordance with the message, and takes away the paper getting jammed.

Then, the user closes the cover or the paper supplying tray which is opened.

In the image forming apparatus 100, the message is displayed at the Step 503 and it is then decided by the CPU 40 whether the cover A (12) or the cover B (13) is opened and closed or not based on a signal sent from the cover opening/closing detecting sensor 14 (Step 504).

If it is not confirmed that the cover A (12) or the cover B (13) is opened and closed (NO in the Step 504), it is then decided by the CPU 40 whether the paper supplying tray 1 (15) is opened and closed or not based on a signal sent from the tray 1 opening/closing detecting sensor (19) (Step 505).

If it is not confirmed that the paper supplying tray 1 (15) is opened and closed (NO in the Step 505), it is thereafter decided by the CPU 40 whether the paper supplying tray 2 (16) is opened and closed or not based on a signal sent from the tray 2 opening/closing detecting sensor (20) (Step 506).

If it is not confirmed that the paper supplying tray 2 (16) is opened and closed (NO in the Step 506), it is subsequently decided by the CPU 40 whether the paper supplying tray 3 (17) is opened and closed or not based on a signal sent from the tray 3 opening/closing detecting sensor (21) (Step 507).

If it is not confirmed that the paper supplying tray 3 (17) is opened and closed (NO in the Step 507), it is then decided by the CPU 40 whether the paper supplying tray 4 (18) is opened and closed or not based on a signal sent from the tray 4 opening/closing detecting sensor (22) (Step 508).

If it is not confirmed that the paper supplying tray 4 (18) is opened and closed (NO in the Step 508), the CPU 40 returns to the Step 504 and executes the processing in the Step 504.

Consequently, the message is displayed at the Step 503 and the CPU 40 then decides whether the cover (the cover A (12) or the cover B (13)) or any of the paper supplying trays is opened and closed or not. If it is confirmed that the cover or any of the paper supplying trays is opened and closed (YES in the Step 504, YES in the Step 505, YES in the Step 506, YES in the Step 507 or YES in the Step 508), a processing of next Step 509 is executed.

Thus, the image forming apparatus 100 has such a structure that the processing of the Step 509 is executed after the confirmation of the operation for opening/closing the cover (the cover A (12) or the cover B (13)) or any of the paper supplying trays. Therefore, the processing of the Step 509 is executed depending on only the operation for opening/closing the paper supplying tray.

Moreover, the image forming apparatus 100 has such a structure that the processing of the Step 509 is executed after the confirmation of the operation for opening/closing the cover (the cover A (12) or the cover B (13)) or any of the paper supplying trays. As compared with a structure in which the processing of the Step 509 is executed only after the confirmation of the operation for opening/closing the cover, therefore, the number of the operations for opening/closing the cover is decreased. Consequently, it is possible to prevent a deterioration in a cover opening/closing component more greatly.

At the Step 509, the CPU 40 decides whether the jam is released or not and records the jam flag.

Figure 7:
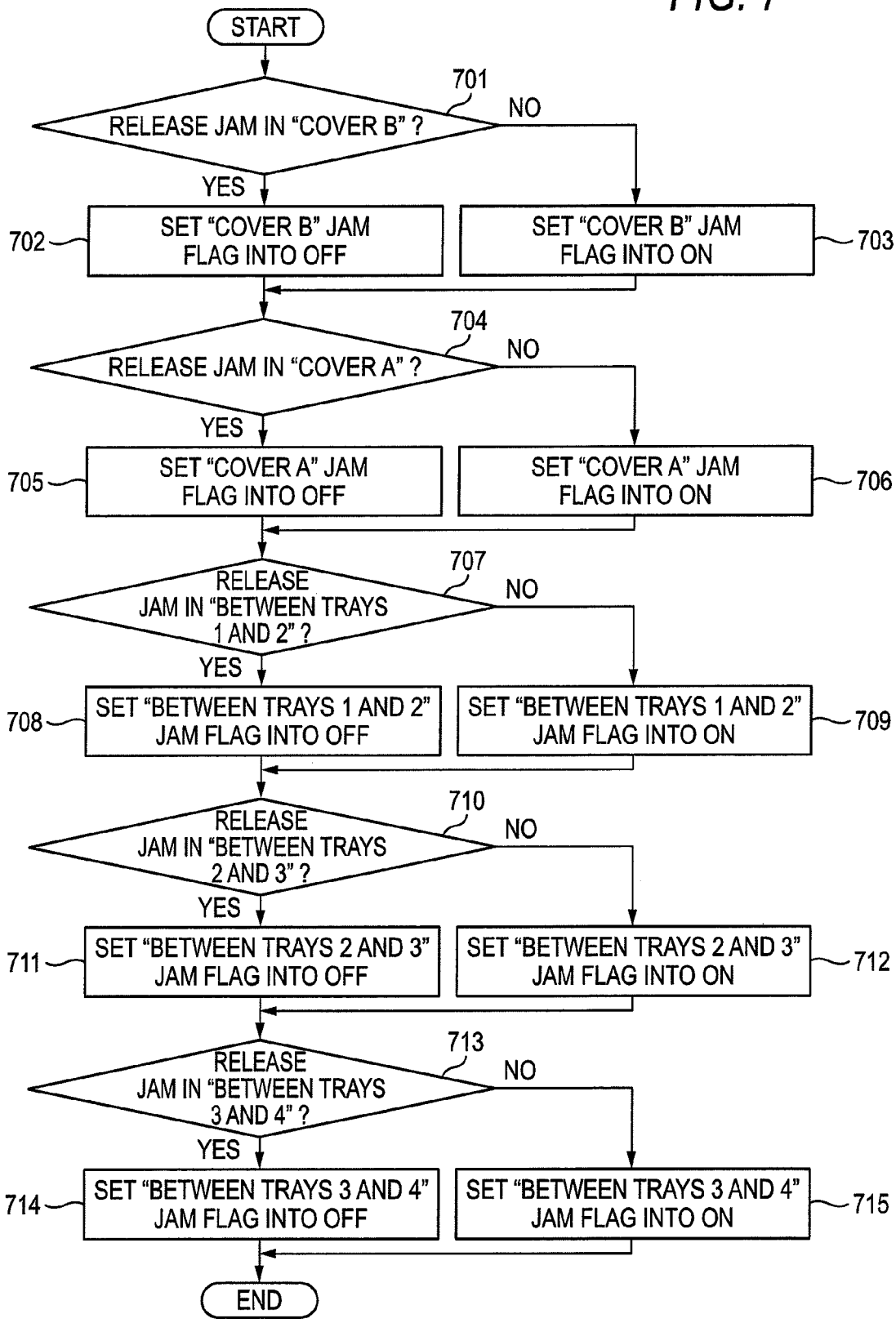
FIG. 7 is a flowchart showing a jam release deciding and jam flag recording processing.

With reference to FIG. 7, description will be given to the processing for deciding the jam release and recording the jam flag through the CPU 40 which is to be executed at the Step 509.

FIG. 7 is a flowchart showing the processing for deciding the jam release and recording the jam flag which is to be executed by the CPU 40.

As shown in FIG. 7, the CPU 40 decides whether the jam in the jam zone "Cover B" is released or not based on the jam releasing condition of the jam zone "Cover B" (Step 701). The jam releasing condition of the jam zone "Cover B" indicates that the duplex sensor 33 is set into a paper non-detecting state as described with reference to FIG. 3.

If the duplex sensor 33 is set into the paper non-detecting state at the Step 701 (YES in the Step 701), the CPU 40 records, as "off", the jam flag in the "Cover B" to be recorded in the RAM 42 on the assumption that the jam in the "Cover B" is released (Step 702). Alternatively, if the duplex sensor 33 is set into a paper detecting state (NO in the Step 702), the jam flag in the "Cover B" to be recorded in the RAM 42 is maintained to be "on" or is recorded to be "on" on the assumption that the jam in the "Cover B" is not released (Step 703).

Then, the CPU 40 decides whether the jam in the jam zone "Cover A" is released or not based on the jam releasing condition of the jam zone "Cover A" (Step 704). The jam releasing condition of the jam zone "Cover A" indicates that the registration sensor 31 is set into the paper non-detecting state as described with reference to FIG. 3.

If the registration sensor 31 is set into the paper non-detecting state at the Step 704 (YES in the Step 704), the CPU 40 records, as "off", the jam flag in the "Cover A" to be recorded in the RAM 42 on the assumption that the jam in the "Cover A" is released (Step 705). Alternatively, if the registration sensor 31 is set into the paper detecting state (NO in the Step 704), the jam flag in the "Cover A" to be recorded in the RAM 42 is maintained to be "on" or is recorded to be "on" on the assumption that the jam in the "Cover A" is not released (Step 706).

Thereafter, the CPU 40 decides whether the jam in the jam zone "Between trays 1 and 2" is released or not based on the jam releasing condition of the jam zone "Between trays 1 and 2" (Step 707). The jam releasing condition of the jam zone "Between trays 1 and 2" indicates that the tray 2 pass sensor (34) is set into the paper non-detecting state as described with reference to FIG. 3.

If the tray 2 pass sensor (34) is set into the paper non-detecting state at the Step 707 (YES in the Step 707), the CPU 40 records, as "off", the jam flag in the "Between trays 1 and 2" to be recorded in the RAM 42 on the assumption that the jam in the "Between trays 1 and 2" is released (Step 708). Alternatively, if the tray 2 pass sensor (34) is set into the paper detecting state (NO in the Step 707), the jam flag in the "Between trays 1 and 2" to be recorded in the RAM 42 is maintained to be "on" or is recorded to be "on" on the assumption that the jam in the "Between trays 1 and 2" is not released (Step 709).

Subsequently, the CPU 40 decides whether the jam in the jam zone "Between trays 2 and 3" is released or not based on the jam releasing condition of the jam zone "Between trays 2 and 3" (Step 710). The jam releasing condition of the jam zone "Between trays 2 and 3" indicates that the tray 3 pass sensor (35) is set into the paper non-detecting state as described with reference to FIG. 3.

If the tray 3 pass sensor (35) is set into the paper non-detecting state at the Step 710 (YES in the Step 710), the CPU 40 records, as "off", the jam flag in the "Between trays 2 and 3" to be recorded in the RAM 42 on the assumption that the jam in the "Between trays 2 and 3" is released (Step 711). Alternatively, if the tray 3 pass sensor (35) is set into the paper detecting state (NO in the Step 710), the jam flag in the "Between trays 2 and 3" to be recorded in the RAM 42 is maintained to be "on" or is recorded to be "on" on the assumption that the jam in the "Between trays 2 and 3" is not released (Step 712).

Then, the CPU 40 decides whether the jam in the jam zone "Between trays 3 and 4" is released or not based on the jam releasing condition of the jam zone "Between trays 3 and 4" (Step 713). The jam releasing condition of the jam zone "Between trays 3 and 4" indicates that the tray 4 pass sensor (36) is set into the paper non-detecting state as described with reference to FIG. 3.

If the tray 4 pass sensor (36) is set into the paper non-detecting state at the Step 713 (YES in the Step 713), the CPU 40 records, as "off", the jam flag in the "Between trays 3 and 4" to be recorded in the RAM 42 on the assumption that the jam in the "Between trays 3 and 4" is released (Step 714). Alternatively, if the tray 4 pass sensor (36) is set into the paper detecting state (NO in the Step 713), the jam flag in the "Between trays 3 and 4" to be recorded in the RAM 42 is maintained to be "on" or is recorded to be "on" on the assumption that the jam in the "Between trays 3 and 4" is not released (Step 715).

Thus, there is executed the processing for deciding whether the jam is released or not and recording the jam flag at the Step 509.

With reference to FIG. 5, description will be subsequently given to the processing in the image forming apparatus 100. When the processing of the Step 509 is executed, the CPU 40 confirms the jam flag to be recorded in the RAM 42 and decides whether the jam flags in all of the jam zones are off or not as shown in FIG. 5 (Step 510).

If the jam flags in all of the jam zones are not "off" at the Step 510 (NO in the Step 510), the processing returns to the Step 503 (through a connector B of the flowchart) and the message corresponding to the jam zone having the jam flag of "on" is displayed on the displaying/operating portion 1 (Step 503).

If the jam flags in all of the jam zones are "off" at the Step 510 (YES in the Step 510), moreover, the CPU 40 displays, on the displaying/operating portion 1, a message indicating a completion of the paper jam processing (Step 511).

Then, the processing is ended so that the image forming apparatus 100 is returned into a print enabling state.

When the message indicating the completion of the paper jam processing is displayed at the Step 511 and the print processing is subsequently started, the processing for detecting the jam and recording the jam flag at the Step 501 is started in the image forming apparatus 100.

In the image forming apparatus 100, thus, the user takes away the paper getting jammed and it is then decided whether the jam is released or not after the operation for opening/closing any of the paper supplying trays in addition to the operation for opening/closing the cover A (12) or the cover B (13), and a notice of the completion of the paper jam processing is displayed.

Figure 8A:
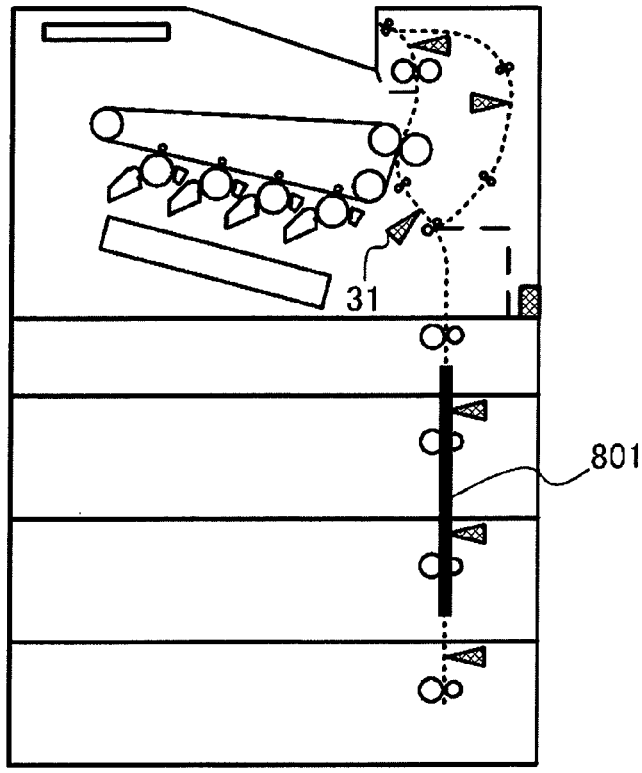
FIGS. 8A and 8B are typical views showing state in which the image forming apparatus 100 is jammed with a paper.
Figure 8B:
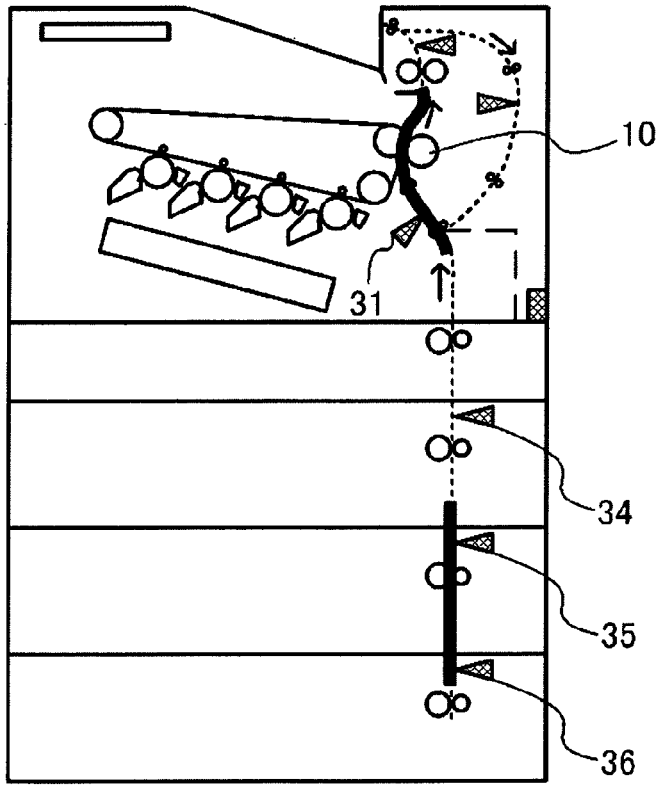

With reference to FIGS. 8A and 8B, next, description will be given to a processing to be executed by the image forming apparatus 100 by taking, as an example, a state in which the image forming apparatus 100 is jammed with the paper.

FIGS. 8A and 8B are typical views showing a state in which the image forming apparatus 100 is jammed with the paper, and FIG. 8A is a typical view showing the image forming apparatus 100, illustrating an example in which an ON-jam is detected by the registration sensor 31 and FIG. 8B is a typical view showing a state in which the ON-jam is detected by the exit sensor 32 and the image forming apparatus 100 is jammed with plural of papers.

As shown in FIG. 8A, when there is caused the paper jam in which the ON-jam is detected by the registration sensor 31, it is assumed that the jam in the jam zone "Between trays 1 and 2" occurs and the jam flag in the jam zone "Between trays 1 and 2" is recorded to be "on" at the Step 501 described with reference to FIG. 5 in the image forming apparatus 100.

At the Step 502, then, the jam flag in the jam zone "Between trays 1 and 2" is "on" (YES in the Step 502). Therefore, the message corresponding to the jam zone "Between trays 1 and 2" is displayed on the displaying/operating portion 1 (Step 503).

After the message is displayed, the user opens the paper supplying tray 1 (15) and the paper supplying tray 2 (16) in accordance with the message displayed on the displaying/operating portion 1 to take away the paper getting jammed.

Thereafter, the user closes the paper supplying tray 1 (15) and the paper supplying tray 2 (16).

In the image forming apparatus 100 in which the paper supplying tray 1 (15) and the paper supplying tray 2 (16) are closed, the CPU 40 confirms that the paper supplying tray 1 (15) is opened and closed. Therefore, the decision of the Step 505 is YES so that the processing proceeds to the Step 509.

When all of the paper detecting sensors are brought into the paper non-detecting state at the Step 509, all of the jam flags are "off" at the Step 510. Therefore, the notice of the completion of the paper jam processing is displayed on the displaying/operating portion 1 so that the processing is ended.

When there is caused the paper jam in which the ON jam is detected by the exit sensor 32 as shown in FIG. 8B, moreover, it is assumed that the jam in the jam zone "Cover A" occurs and the jam flag in the jam zone "Cover A" is recorded to be "on" at the Step 501 described with reference to FIG. 5 in the image forming apparatus 100.

In addition, in a state in which the image forming apparatus 100 is jammed with plural of papers as shown in FIG. 8B, the ON-jam is detected by the exit sensor 32 in relation to a transport of a single paper, and furthermore, the ON-jam is detected by the tray 2 pass sensor (34) in relation to a transport of the other papers in some cases. In these cases, it is assumed that the jam in the jam zone "Between trays 2 and 3" occurs so that the jam flag in the jam zone "Between trays 2 and 3" is also recorded to be "on" at the Step 501 based on the ON jam detection through the tray 2 pass sensor (34).

At the Step 502, then, the CPU 40 confirms that the jam flags in the jam zones are "on" (the jam flags in the "Cover A" and the "Between trays 2 and 3" are "on").

If the jam flags in the jam zones are "on", it is also possible to display, on the displaying/operating portion 1, messages corresponding to all of the jam zones in which the jam flags are recorded to be "on" or to display messages corresponding to only a part of the jam zones which are preferential based on preset priority of the jam zones having the jam flags of "on".

In the case in which the column of the displaying/operating portion 1 for displaying the message is small (for example, only two lines) and all of the messages corresponding to all of the jam zones in which the jam flags are recorded to be "on" cannot be displayed, it is possible to produce an advantage that a structure for displaying the messages corresponding to only a part of the jam zones having the priority is compatible with a machine type having a small display column.

The preset priority of display for the jam zone includes the "Cover B", the "Cover A", the "Between trays 1 and 2", the "Between trays 2 and 3" and the "Between trays 3 and 4" in descending order, for example, and higher priority is given to the downstream side of the paper transporting path.

The reason is as follows. First of all, if the paper is moved in a reverse direction to a paper transporting direction by the user when the paper getting jammed is to be taken away, there is a possibility that the component such as the paper detecting sensor might be broken in the image forming apparatus 100 in which the paper is assumed to be moved in only the paper transporting direction.

In order to eliminate the possibility of the breakage, therefore, it is desirable to take the paper away from the downstream side of the paper transporting path if possible when the paper getting jammed is to be taken away.

In some cases in which the papers are continuously transported in a state in which an interval between the papers is small through high-speed printing, moreover, plural of jam flags can be set into "on" and the cover or the paper supplying tray can be opened to take away the paper getting jammed, and then, the paper on the upstream side of the transporting path which is transported subsequently to the paper thus taken away can also be taken away in a forward direction to the paper transporting direction in order to release the jam on the downstream side of the paper transporting path.

For this reason, it is desirable to give priority in order to display a message from the jam zone at the downstream side of the paper transporting path.

In some cases in which the inversion transporting path 38 is placed on the upstream side of the paper transporting path in a paper transport for duplex printing, it is also possible to set the jam zone "Cover A" to have priority over the jam zone "Cover B".

Figures 9A, 9B, 9C:
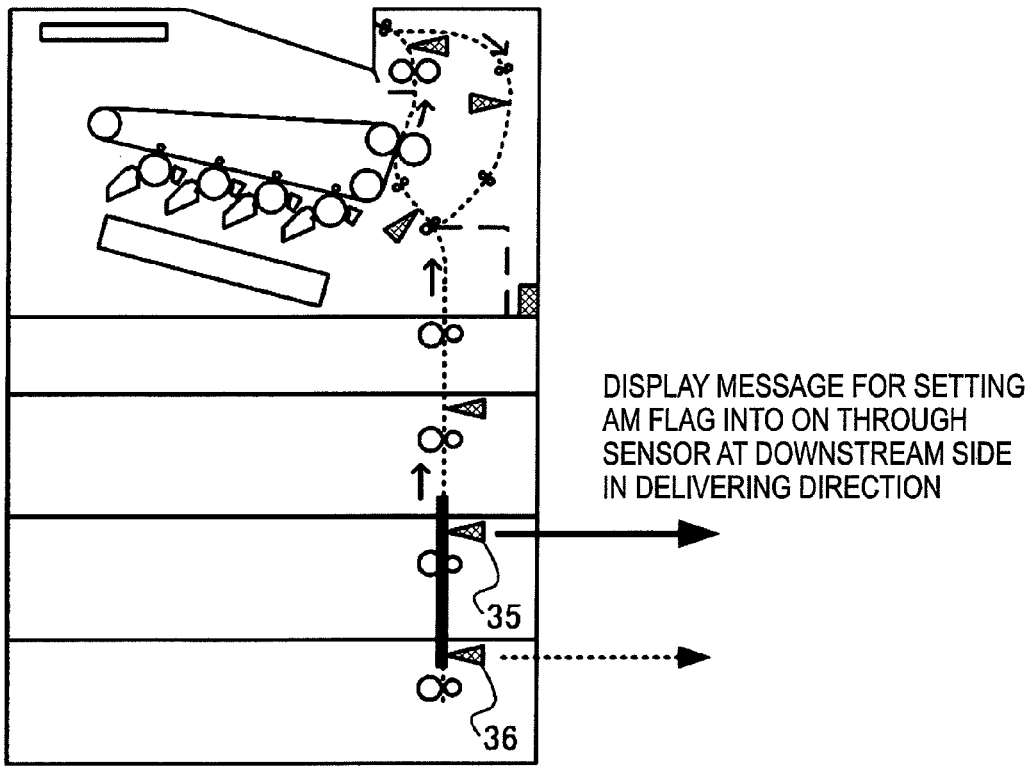
FIGS. 9A to 9C are typical views showing message to be displayed on a displaying/operating portion 1.

If "on" of the jam flags in the "Cover A" and the "Between trays 2 and 3" is confirmed at the Step 502, a message corresponding to only the jam zone "Cover A" is displayed as shown in FIG. 9A in the case in which messages corresponding to a part of the jam zones which are preferential are displayed.

The user opens the cover A (12) to take away the paper getting jammed, and then closes the cover A (12) in accordance with the message.

In the image forming apparatus 100, consequently, the CPU 40 confirms that the cover A (12) is opened and closed (YES in the Step 504) and the processing of the Step 509 is then executed.

In the processing of the Step 509, the paper getting jammed is disposed across the detecting regions of the two paper detecting sensors including the tray 3 pass sensor (35) and the tray 4 pass sensor (36). Therefore, the tray 3 pass sensor (35) and the tray 4 pass sensor (36) are brought into the paper detecting state, and the jam flag in the jam zone "Between trays 2 and 3" is recorded to be "on" at the Step 712 and the jam flag in the jam zone "Between trays 3 and 4" is recorded to be "on" at the Step 715.

In the processing of the Step 510, all of the jam flags are not "off" (NO in the Step 510). At the next Step 503 (through the connector B), there is displayed a message corresponding to the jam zone "Between trays 2 and 3" having the jam flag of "on" and priority over the jam zone "Between trays 3 and 4" (Step 503).

Referring to the message to be displayed on the displaying/operating portion 1 after the decision of the jam release (the processing of the Step 503 to which the routine proceeds via the Steps 509 and 510), thus, only a message corresponding to the jam zone having higher preset priority is displayed when "on" of the jam flags is confirmed.

In the case in which the paper detecting sensors are set into the paper detecting state as shown in FIG. 9B after the decision of the jam release at the Step 509, consequently, only a message corresponding to the jam zone on the downstream side in the paper transporting direction is displayed. Therefore, it is possible to produce an advantage that the paper is taken away from the downstream side in the paper transporting direction.

In the case in which the paper detecting sensors are set into the paper detecting state as shown in FIG. 9B after the decision of the jam release, a message corresponding to the jam zone "Between trays 2 and 3" having the jam flag set into "on" based on the paper detection of the tray 3 pass sensor (35) is displayed with priority over a message corresponding to the jam zone "Between trays 3 and 4" having the jam flag set into "on" based on the paper detection of the tray 4 pass sensor (36), and the message corresponding to the jam zone "Between trays 2 and 3" is displayed on the displaying/operating portion 1 as shown in FIG. 9C (Step 504).

Then, the user opens the paper supplying tray to take away the paper getting jammed in accordance with the message displayed on the displaying/operating portion 1, and then closes the paper supplying tray.

When the paper supplying tray is closed, the CPU 40 confirms that any of the paper supplying trays is opened and closed through any of the Steps 505 to 508. At the Step 509, the jam release is decided and the jam flag is recorded again.

After all of the papers getting jammed are taken away, all of the paper detecting sensors are brought into the paper non-detecting state. Therefore, all of the jam flags are recorded to be "off" (YES in the Step 510) and the notice of the completion of the paper jam processing is displayed on the displaying/operating portion 1 (Step 511) so that the processing is ended.

Although the description has been given on the assumption that there is provided the four-stage tray in which the number of the paper supplying trays is four in the example, the invention is not restricted to the same number.

Second Example

In the example, next, description will be given to an example of an improvement in the image forming apparatus 100 explained in the first example.

In an image forming apparatus 100 to be described in the example, a part of the processings described with reference to FIG. 5 in the first example are subjected to programming so as to be executed more efficiently.

In the example, the description will be given on the assumption that components and devices which have the same reference numerals as those used in the explanation of the first example have the same structures and functions as those explained in the first example if they are not particularly described (so are the reference numerals in the flowcharts).

The processing of the image forming apparatus 100 to be explained in the example will be described with reference to FIG. 10.

Figure 10:
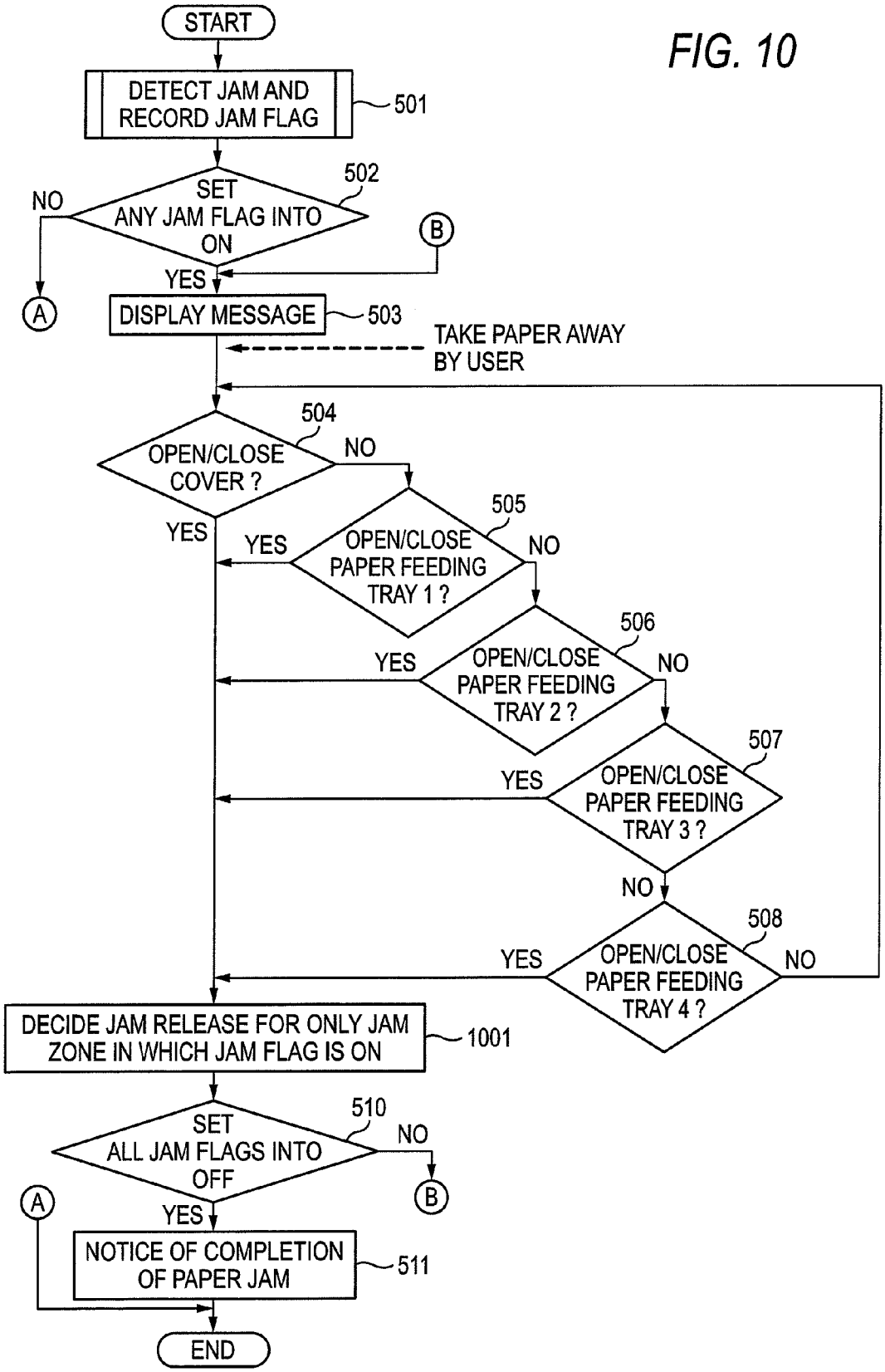
FIG. 10 is a flowchart showing a processing for deciding a jam release in only a jam zone having a jam flag of "on".

FIG. 10 is a flowchart showing the processing of the image forming apparatus 100 in which the processing at the Step 509 in the flowchart described with reference to FIG. 5 in the first example is different.

As shown in FIG. 10, in the image forming apparatus 100, processings from Step 501 to Step 508 are the same as the processings described with reference to FIG. 5 in the first example. Therefore, the description of the processings will be omitted.

If a CPU 40 confirms that a cover is opened/closed or any of paper supplying trays is opened/closed (YES in the Step 504, YES in the Step 505, YES in the Step 506, YES in the Step 507 or YES in the Step 508), the processing then proceeds to Step 1001.

At the Step 1001, a jam release is decided and a jam flag is recorded. In the example, however, the jam release is not decided in all of jam zones differently from the first example but the CPU 40 decides the jam release for only the jam zone having the jam flag recorded to be "on" in an RAM 42. The CPU 40 first checks the RAM 42 and confirms the jam zone having the jam flag of "on" (Step 1001). Then, the CPU 40 executes a processing for deciding whether the jam is released for only the jam zone having the jam flag of "on" or not (Step 1001). The processing for deciding whether the jam is released or not is the same as the processing described in the first example and a jam releasing condition to be used in the processing is the same as the content described with reference to FIG. 3 in the first example. Therefore, detailed description will be omitted.

The CPU 40 decides the jam release for only the jam zone having the jam flag recorded to be "on". As a result, the CPU 40 records the jam flag in the jam zone to be "off" if the jam in the jam zone is released, and the CPU 40 maintains the jam flag in the jam zone to be "on" if the jam in the jam zone is not released (Step 1001).

In the example, thus, the jam release is decided for only the jam zone in which the jam flag is set into "on" and an occurrence of the jam is recorded at a start of the processing in the Step 1001. As compared with the case in which the jam release is decided for all of the jam zones, therefore, it is possible to produce an advantage that a processing can be executed efficiently.

When the CPU 40 records the jam flag to be "off" or maintains the jam flag to be "on" at the Step 1001, the same processing as that described with reference to FIG. 5 in the first example will be subsequently executed as a processing of Step 510.

Since processings after the Step 510 are the same as those described with reference to FIG. 5 in the first example, description will be omitted.

Although the description has been given on the assumption that there is provided the four-stage tray in which the number of the paper supplying trays is four in the example, the invention is not restricted to the same number.

The invention can be utilized in an image forming apparatus and a computer readable medium.

The computer readable medium according to the invention can be offered by communicating means, and furthermore, can be recorded on a recording medium such as a CD-ROM and can be thus offered.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. An image forming apparatus comprising:

a plurality of paper supplying trays that stores a paper to form an image;

an image forming unit that forms the image on the paper supplied from the paper supplying tray;

a cover to be opened by an operator in order to take away the paper getting jammed in the image forming unit;

a cover opening/closing detecting unit that detects an operation for opening/closing the cover by the operator;

a paper supplying tray opening/closing detecting unit that detects an operation for opening/closing any of the plurality of paper supplying trays;

a paper jam detecting unit that detects a paper jam in at least one place in a paper transporting path through which the paper is transported, and the paper jam detecting unit has a detecting result holding unit that puts up a detecting flag corresponding to the place where the paper jam is detected so as to hold a detecting result from the paper jam detecting unit;

a confirming unit that confirms a first detection of the operation for opening/closing the cover through the cover opening/closing detecting unit after the paper jam is detected by the paper jam detecting unit or a second detection of the operation for opening/closing the paper supplying tray through the paper supplying tray opening/closing detecting unit;

a paper jam release deciding unit that decides whether the paper jam in the detecting place is released or not after the confirmation of the first or second detection through the confirming unit; and a completion control unit that controls to complete a paper jam processing based on the decision that the paper jam in all of the places in the paper transporting path is released through the paper jam release deciding unit.

2. The image forming apparatus according to claim 1, wherein the release deciding unit invalidates the detecting flag corresponding to a place in which the paper jam is decided to be released.

3. The image forming apparatus according to claim 1, further comprising:

at least one paper detecting unit that detects a presence of the paper in the paper transporting path, wherein the paper jam detecting unit detects the paper jam in at least one place based on information detected by the at least one paper detecting unit.

4. The image forming apparatus according to claim 1, wherein the paper jam release deciding unit decides whether the paper jam is released or not based on the information detected by the paper detecting unit.

5. The image forming apparatus according to claim 1, wherein the paper jam detecting unit displays, on a displaying portion, information about the detected paper jam.

6. The image forming apparatus according to claim 5, further comprising a plurality of paper detecting unit that detects a presence of the paper in the paper transporting path, the paper jam detecting unit displays, on the displaying portion, information about the paper jam based on the paper detecting unit in a place positioned on a downstream side of the paper transporting path when the paper jam in a plurality of places based on the paper detecting unit is detected.

7. The image forming apparatus according to claim 1, wherein the paper jam detecting unit determines whether the paper arrives at the paper jam detecting unit within a predetermined time.

8. The image forming apparatus according to claim 1, wherein the paper jam detecting unit determines whether the paper is continuously detected by the paper jam detecting unit.

* * * * *